United States Patent [19]

Harris et al.

[11] 4,092,128

[45] May 30, 1978

[54] DESULFURIZED GAS PRODUCTION FROM VERTICAL KILN PYROLYSIS

[75] Inventors: Harry A. Harris, Rifle; John B. Jones, Jr., Grand Junction, both of Colo.

[73] Assignee: Paraho Corporation, Grand Junction, Colo.

[21] Appl. No.: 689,079

[22] Filed: May 24, 1976

[51] Int. Cl.[2] ..... C10K 1/20

[52] U.S. Cl. ..... 48/197 R; 48/210; 201/28; 201/37; 423/244; 423/232

[58] Field of Search ..... 48/197 R, 211, 213, 48/201, 210; 201/27, 28, 34, 37, 45; 208/11, 80; 423/175, 244, 230, 232; 431/174

[56] References Cited

U.S. PATENT DOCUMENTS

| | | | |
|---|---|---|---|
| 3,106,521 | 10/1963 | Huntington | 48/197 R |
| 3,409,509 | 11/1968 | Gould | 208/11 R |
| 3,421,868 | 1/1969 | Feldmann | 48/197 R |
| 3,503,869 | 3/1970 | Haddad et al. | 201/34 |
| 3,907,519 | 9/1975 | Sieg et al. | 48/197 R |
| 3,928,532 | 12/1975 | Squires | 423/244 |
| 3,949,684 | 4/1976 | Copeland | 48/197 R |
| 3,966,431 | 6/1976 | Craig et al. | 48/197 R |

*Primary Examiner*—Robert L. Lindsay, Jr.
*Assistant Examiner*—George C. Yeung
*Attorney, Agent, or Firm*—Richard D. Law

[57] ABSTRACT

A gas, formed as a product of a pyrolysis of oil shale, is passed through hot, retorted shale (containing at least partially decomposed calcium or magnesium carbonate) to essentially eliminate sulfur contaminants in the gas. Specifically, a single chambered pyrolysis vessel, having a pyrolysis zone and a retorted shale gas into the bottom of the retorted shale zone and cleaned product gas is withdrawn as hot product gas near the top of such zone.

11 Claims, 5 Drawing Figures

DESULFURIZED GAS PRODUCTION FROM VERTICAL KILN PYROLYSIS

This invention resulted from work done under Lease Agreement dated May 11, 1972, between the United States (represented by Honorable Rogers C. B. Morton, Secretary of the Interior) and Development Engineering, Incorporated.

This invention relates to the treatment of stack gases (and other gas streams) for the removal of sulfur compositions. This invention, in one aspect, provides a method and means of treatment of product gas internally of a vertical kiln oil shale retorting system for the removal of hydrogen sulfide and sulfur dioxide, and for preheating the gas necessary for combustion in an external combustion system. The sulfur compounds react with the magnesium and calcium oxide present in the retorted shale particles, reacting to form stable sulfide or sulfate compounds. The preheated and desulfurized gas is removed from the vertical kiln at a temperature between 700° and 900° F., eliminating the need for external preheat systems or external desulfurizing systems to provide a produced gas ready for use.

Oil shale, i.e., a rock or mineral commonly called an oil shale is found in many parts of the world, with substantial beds of the oil shale particularly in Colorado, Utah and Wyoming. A number of small size commercial operations for recovering an oil from oil shale have been carried out in many countries of the world, including the United States. However, currently there are no large commercial plants in the United States. With the depletion of easily available petroleum, substantial amounts of research have been done for the recovery of shale oil from the oil shale.

Shale oil is not a naturally occurring product in the oil shale, and to produce shale oil from the rock, it is subjected to a pyrolysis. The organic matter in the oil shale is converted to some permanent gas, some condensable gas, a liquid called shale oil, and a carbonaceous residue. In the rock, the organic material has a limited solubility in ordinary solvents, but upon strong heating a shale oil is formed which resembles petroleum in some respects. Shale oil produced from shale from various sources may be quite different in properties. Two major factors affecting the differences in different oils are the oil shale source and the method of processing such rock to produce the oil. One of the significant differences between oil shales from different sources is the inorganic or mineral consitituents of the oil shale. For example, the western oil shales from the Green River formation contain about ⅓ dolomite with the balance made up of feldspar, calcite, clay minerals, quartz, and iron pyrite. Other oil shales in the United States, such as the Devonian Shales in Ohio, Indiana, Kentucky, and Tennessee, contain a similar organic material but the inorganic material is different from the Green River shales. Dolomite appears to be absent from the inorganic content of the Devonian shales.

The pyrolysis of organic material in oil shale, in its fundamental aspects, appears to be a relatively simple operation. The process involves heating the shale to a proper temperature and recovering the products which are emitted from the shale. In practical application, however, this apparently simple operation has not been achieved in a large commercial application even though dozens of types of processes and literally hundreds of types of equipment have been devised for the oil shale retorting process. The large investment capital required for an oil shale complex has been discouraging. In one general method, oil shale is mined, reduced to relatively small particles, fed to a kiln where it is heated to a temperature necessary to produce the required pyrolysis. The pyrolysis, generally, produces first a vapor which is cooled to produce a mist of small liquid oil droplets and various gases which are withdrawn from the particulate shale. The retorted shale is subsequently discarded. One effective type of retorting vessel is a vertical shaft kiln, such as shown in the U.S. Pat. Nos. 3,736,249, patented May 29, 1973, 2,757,129, patented July 31, 1956, 2,901,402, patented Aug. 25, 1959, and 3,841,992, patented Oct. 15, 1974, among many others.

An effective process has been achieved in a shaft kiln by a gravity flow, continuously moving shale bed in the kiln, produced by feeding solids to the top and withdrawing solids from the bottom to maintain a uniform depth of bed. The retort includes essentially three vertically aligned zones, namely, a top preheating zone for the shale (which also provides for the disengagement of the products of pyrolysis from the raw shale), a mid-zone for pyrolysis and a cooling zone below the pyrolysis zone. This process utilizes incoming ambient temperature solids to cool the rising stream of the produced products from the pyrolysis, so that the products leave the bed at a relatively low temperature. The shale oil vapors become condensed as a fine liquid mist carried from the retort by entrainment in the gas stream. For an economic heat balance, the shale leaving the pyrolysis zone is cooled by bottom injected incoming gas. This gas is heated and rises up through the particulate shale, through the retorting zone and is subsequently withdrawn as off-gas with the produced pyrolysis products. One of the pyrolysis products is hydrogen sulfide produced from the decomposition of the organic material called kerogen. However, the equipment needed for removal of $H_2S$ from the product gas requires significant investment capital and operating expense.

Generally speaking, two major processes have been used in the vertical, or shaft, kiln, the first being a direct combustion process in which residual carbon on the shale is burned in the kiln, producing the heat for the pyrolysis; and in the second, being an indirect heat retorting in which a nonoxygenous gas is heated externally of the retort and is introduced immediately below the retorting zone, with the incoming heated gas being of a sufficient temperature to produce pyrolysis.

The present invention utilizes either of the two above vertical kiln retorting processes and involves the disengagement of the produce gas from the vertical kiln at the top of the shale cooling zone and below the pyrolysis zone, the shale cooling zone comprises the lower portion of a column of retorted shale having a temperature profile of from about 200° F at the bottom to about 700° F at the point where the produce gas is disengaged therefrom. This gas, having been in counter-current contact with retorted shale including the magnesium and calcium oxides, has a hydrogen sulfide content of less than 20 ppm. The preheated essentially sulfur free gas from the direct combustion kiln can be utilized efficiently and without further processing in the operation of a combustion gas turbine or burned in a furance to release heat for process purposes or for the generation of steam for process purposes and the production of shaft work through steam turbines. The desulfurized gas from indirect heat retorting is higher in heating value and can be used in direct combustion processes or reformed to produce a synthesis gas. By virtue of its low hydrogen sulfide content, the purification steps preceding the synthesis gas process are greatly simplified.

Included among the objects and advantages of the present invention is to provide a method of operating a vertical kiln in a manner to produce essentially sulfur free product gas which is preheated and suitable for immediate use in a combustion operation.

Another object of the invention is to produce a rich pyrolysis gas which is essentially sulfur free and requiring minimum additional processing for subsequent use in combustion processes or the conversion of the rich gas to synthesis gas.

A further object of the invention is to utilize the vertical counter-current pyrolysis kiln to produce essentially sulfur free gas from non-carbonate oil shales and from coal.

These and other objects and advantages of the present invention may be readily ascertained by referring to the following description and appended illustrations in which.

A vertical kiln, utilized to perform the invention, is a vertical vessel, common to calcining or retorting arts, having a top feed for pulverulent rock or oil shale and a bottom discharge, which is arranged to discharge solids from the kiln at a rate to maintain continuously moving, but essentially constant depth of bed in the kiln. Various gases are introduced into the kiln at various positions, with gas distributors provided between the ends of the kiln. Such a distributor as is shown in U.S. Pat. No. 3,432,348, issued Mar. 11, 1969, may be used for providing a laterally uniform distribution of gas across the kiln. One means for withdrawing solids from the bottom of the kiln is commonly called a grate and a suitable grate is shown in U.S. Pat. No. 3,401,992, issued Sept. 17, 1968 entitled Linear Grate for Shaft Kilns. The grate and the gas distribution means provide an excellent system for the uniform flow of solids through the kiln, particularly laterally and across its cross-sectional extent of the kiln, so that all solid particles are equally treated with the gases of the process. If the solid feed size consist is from ½ to 2½ inches, the void space in the bed is about 40%. With continuous movement of the bed, there is particle contact readjustment, but the void space remains constant. However, new surfaces of the solid particles are exposed to the gas providing highly efficient heat transfer and reaction of gas with the solid surfaces. In the present invention, it is the reaction of hydrogen sulfide and sulfur dioxide in the gas with magnesium and calcium oxides which are present by virtue of partial calcination of the respective carbonates in the oil shale. If the kiln feed contains no carbonates, this is achieved by the addition of dolomite or limestone to the kiln feed. By maintaining a uniform flow of shale through the kiln, combustion may be initiated in the particular zone and it may be maintained in that zone by careful control of the gases introduced into the kiln. In the direct combustion process, the heat produced by combustion is transferred into the upper section of the kiln for retorting the raw shale, and the circulated gas along with the mist of oil is withdrawn from the kiln for processing. The processing includes the removal of the liquids, and return of all of the gas to the kiln.

Figure 1:
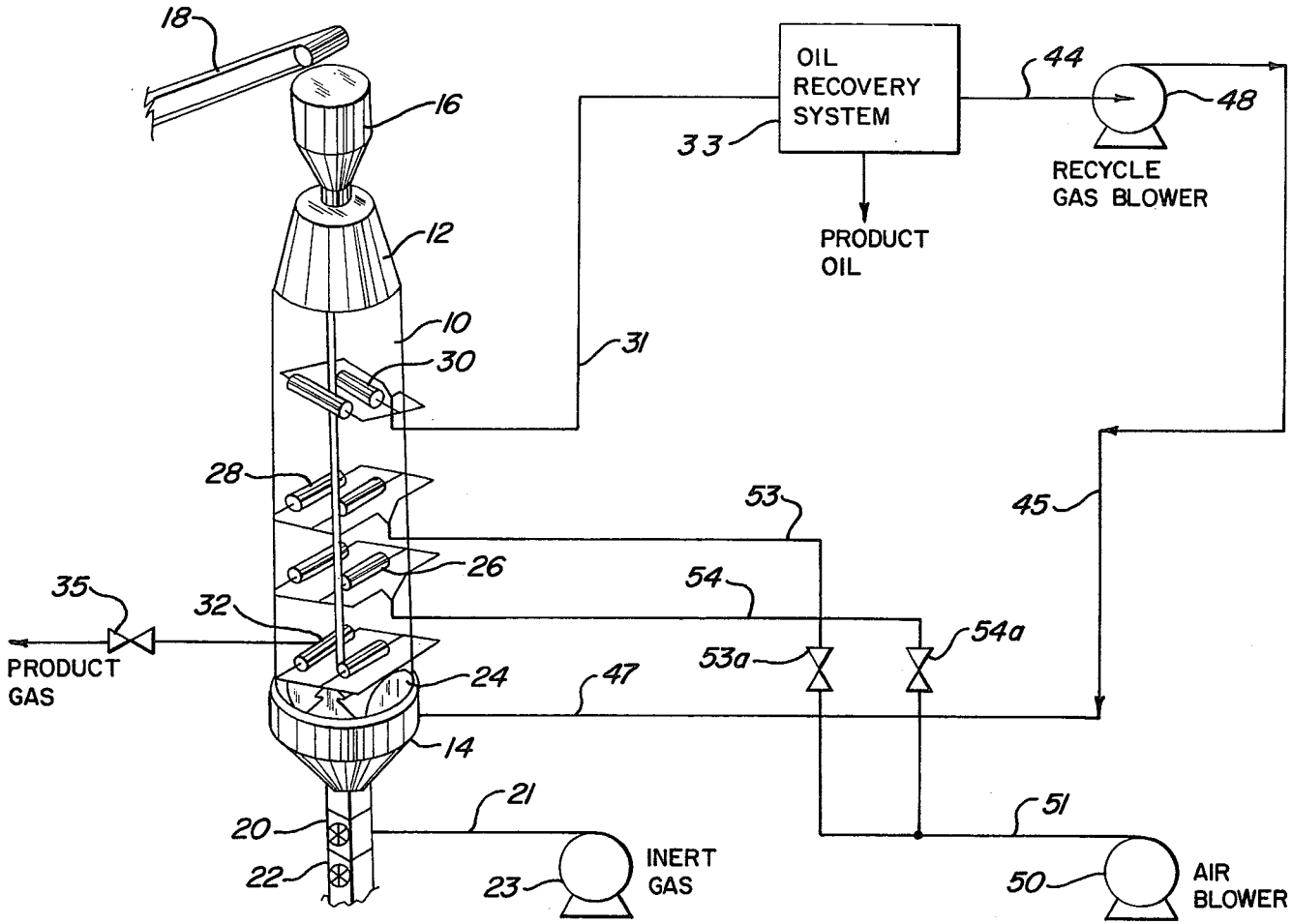
FIG. 1 is a flow diagram of a direct heated retort and arrangement of the recovery system.

In the system shown in FIG. 1, a vertical kiln 10, shown in phantom, and generally it consists of a metal skin and refractory lining as is common art. The kiln is provided with a top feed cone 12 and a bottom withdrawal cone 14 secured to the ends of the vertical cylindrical member. A feed hopper 16, fed by a belt conveyor, 18, provides a gravity flow of crushed shale into the kiln. A pair of star feeders, 20 and 22, mounted on the outlet of the lower end 14, provide the means for withdrawing retorted shale from the kiln. A grate mechanism, not shown, is mounted in the lower end 14, below a gas inlet means 24, which includes side and middle distributor means for injecting gas into the bottom of the column of shale in the kiln. A first set of tubular gas distributors 26, is mounted in the kiln substantially above the bottom distributor 24, and a second set of tubular distributors 28, is mounted thereabove. An off-gas collection system 30, is provided above the upper distributor system 28, and provides means for withdrawing gases and mist from the retorting.

In one highly effectively size which has been used for a substantial period of time, a nominal 10-foot diameter kiln with an overall height of about 50½ feet is provided with a bed of shale with a height of approximately 26½ feet from the lowest point of the bed to the feed inlet. The kiln is lined with refractory giving an effective inside diameter of about 8½ feet. The lower gas inlet 24 is just above the grate, and the next or mid-gas distributor 26 is about 12 feet above the lowest part of the bed. The upper distributor 28 is about 6 feet above the middle distributor. The product gas collector 32 is about 10 feet above the lowest part of the bed.

Raw shale is introduced into the kiln through valve means, which prevents the escape of the gaseous products and mist, such known valve devices as, for example, star feeders. The retorted shale is withdrawn from the unit using similar star feeders, rotary feeders or the like for preventing the release of gas from the kiln during the operations of feeding and withdrawing shale. Inert gas may be inserted through line 21 to pressurize the star feeders to prevent the loss of gas. The inert gas is controlled by a blower, 23.

The gas/oil mist produced by the retorting is withdrawn from the bed by off-gas collector system 30, through a line 31, into an oil recovery system 33. The oil recovery system is a collection of equipment for removal of oil mist particles from a gas stream, using equipment such as cyclones, mist extractors, electrostatic precipitators, and the like, which are well known in the art for this service. The generally liquid free gas passes through line 44, to a recycle gas blower 48, into a gas line 45. A portion of the gas in line 45, passes through a line 47, into the bottom of the kiln as recycled gas. Air is introduced into the two internal distributor systems in the kiln from the air blower 50, through line 51, which serves as a manifold to lines 53 (connected to the upper distributors 28) and line 54 (connected to the lower distributors 26) respectively controlled by valves, 53*a* and 54*a*. The distributors are mounted laterally in the kiln and are tubular members fed from both ends.

Gas is released from the distributors through a series of orifices along each side of the tubular members. The size and/or spacing of the orifices are arranged to inject a predetermined quantity of gas/air mixture into the lateral area serviced by the particular orifice. The product gas from pyrolysis and combustion internally in the retort is removed by gas collector 32, at a point about 10 feet above the grate mechanism 24. A gas valve 35, is controlled by the internal retort pressure in the area of the off-gas withdrawal collector designated number 30. Thus, it can be seen that the retort, the oil recovery system and the recycle gas blower and piping are a closed system where the product gas is vented after being collected from inside of the retort rather than in the external piping of the gas handling system as is normally done in the art.

Figure 2:
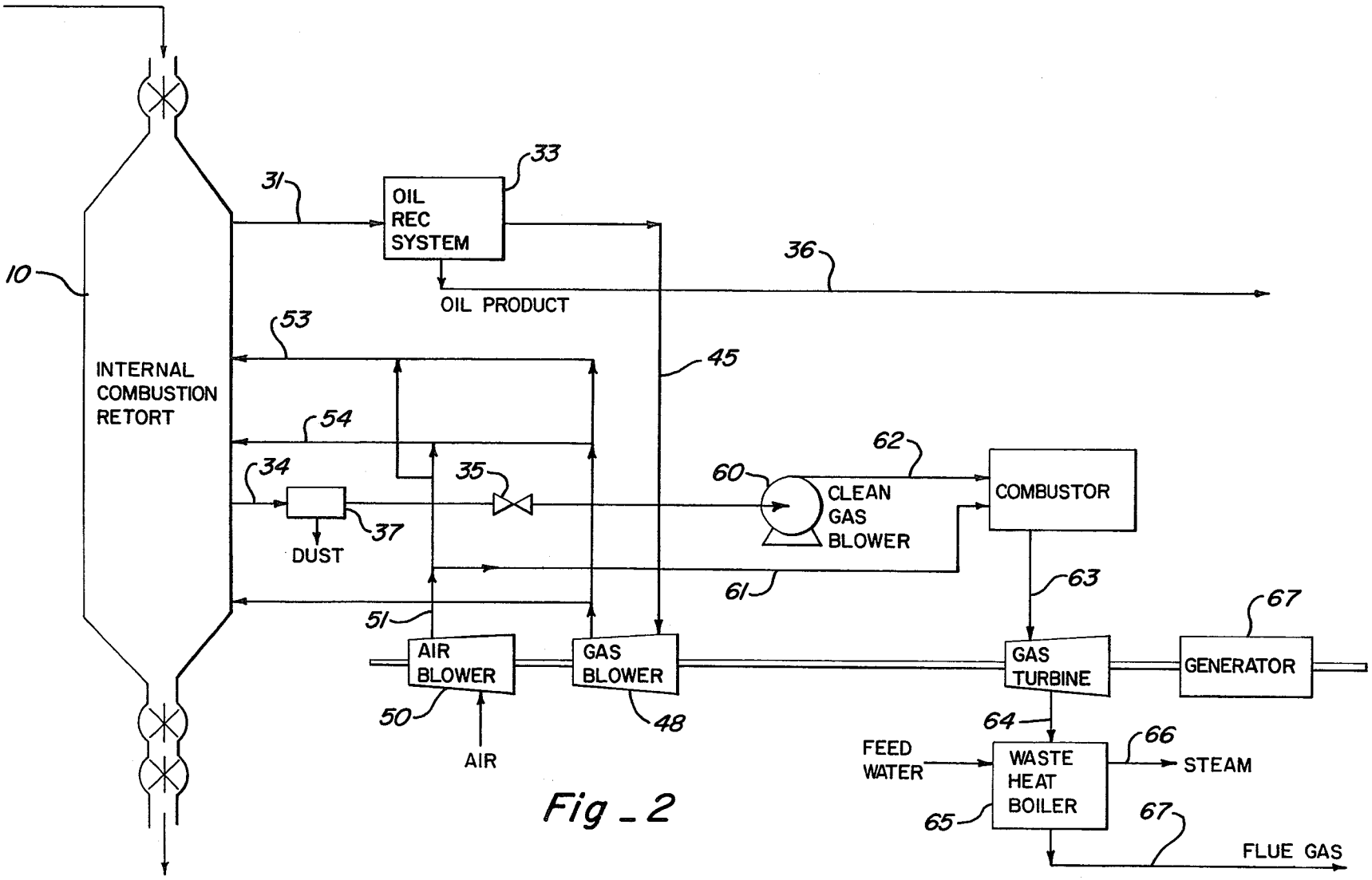
FIG. 2 shows a flow diagram of a direct heated retort and one method of utilizing the essentially sulfur free gas.

An application utilizing the sulfur free product gas from the kiln, FIG. 2, is shown with the gas being burned under pressure to operate a gas turbine to produce shaft power. Although a single shaft is shown turning a generator, a gas blower and an air blower, this is only for illustrative purposes since those who are knowledgeable in the field would be able to apply the principle to a two-shaft turbine operation. The sulfur free gas leaves the retort 10 through line 34 and enters a dust collector 37; the dust collector being a cyclone or other equipment well known to those versed in the art. The partially preheated gas then continues through control valve 35, which operating through a controller maintains the retort top pressure at a predetermined value. The gas, passing the valve, is directed to a clean gas blower 60, where the gas is pressured, and it is then conducted through line 62 into the pressure combustor. A portion of the air compressed from the air blower 50 is directed to the combustor in a line 61 where combustion of the sulfur free gas takes place. The products of combustion leave through line 63 at a temperature, for example, of 1500° F and enters the gas turbine. The hot gas is expanding through the gas turbine converts a substantial portion of its energy to shaft work which turns the turbine shaft. In the process of expansion, the gas loses a substantial portion of its heat and emerges from the gas turbine through line 64 at a temperature about 800° F, and then it enters a waste heat boiler 65 where some of the sensible heat remaining in the gas is used to generate steam from water fed to the waste heat boiler, and the steam leaves the waste heat boiler through line 66. This steam may be used as process steam or other uses for the medium pressure steam thus generated. The waste heat boiler gaseous effluent leaves through line 67 as a flue gas which is essentially free of sulfur dioxide and suitable for direct venting to the atmosphere without further treatment. The excess shaft energy above that required to turn the gas blower and the air blower is used to operate a generator 67 to generate electric power.

Figure 3:
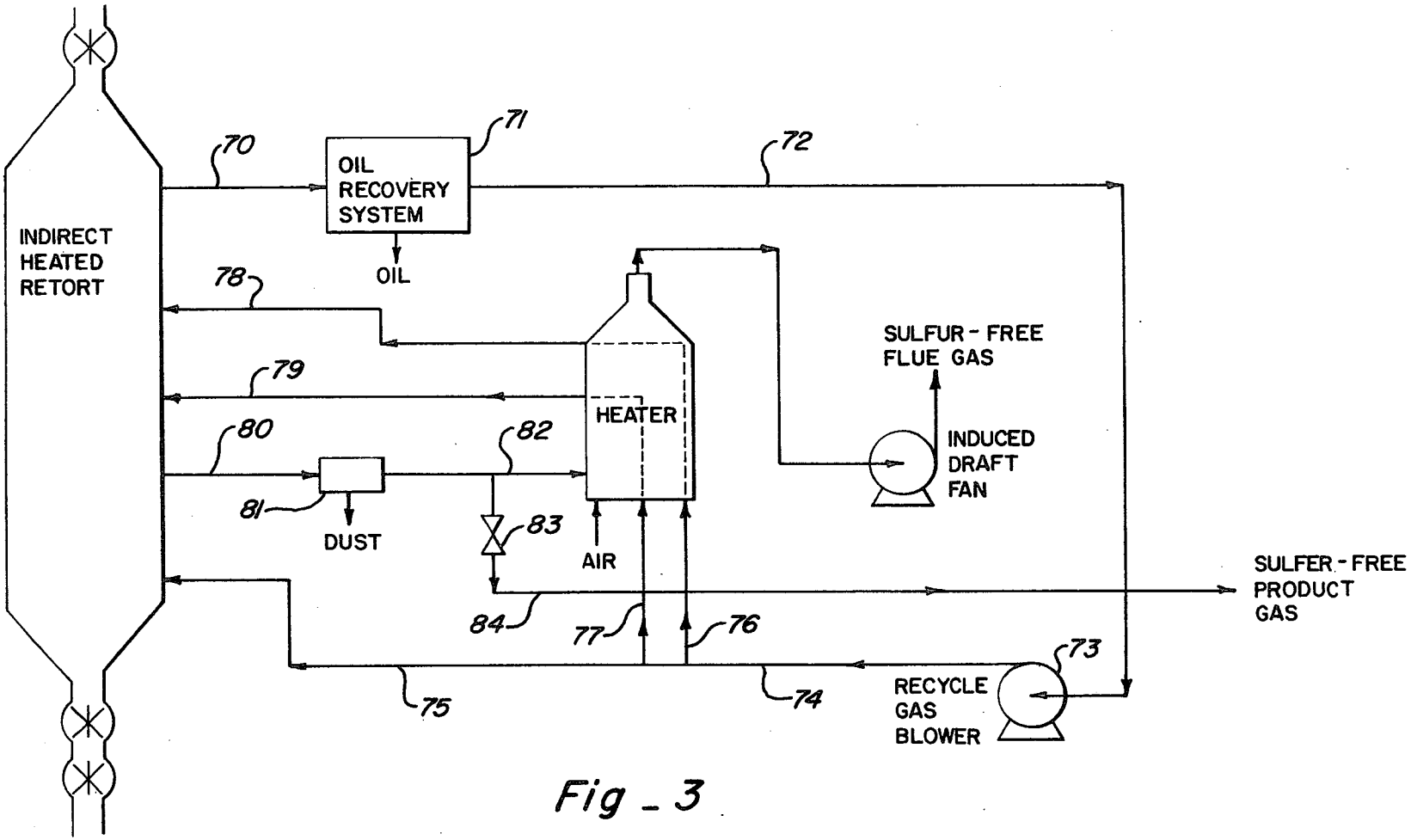
FIG. 3 is a flow diagram of an indirect heated retort according to the invention.

Referring to FIG. 3 an indirect heated vertical retort is shown whereby the hot gas disengaged from the lower zone in the retort passes through a dust collector 81. A portion of this gas is burned in the heater, which is used to heat recirculated gas to furnish the heat of pyrolysis by entry of the hot gas into the central portion of the retort. Thus, the pyrolysis zone is above the point of disengagement of the clean pyrolysis gas from the retort. Relatively cool gas leaves through line 70 at a temperature of about 250° F. bearing an entrained oil mist. In the oil recovery system 71 the oil mist is extracted and the oil free gas then passes through line 72 to the recycle blower 73. The pressured recycle gas in line 74 is divided and passes through line 75 to the bottom of the retort for recovery of the sensible heat of the retorted shale. A portion of the gas passes through line 76 and a portion through line 77 to pass through separate coils of the heater for heating the gas to pyrolysis temperature. The hot gas in line 78, at about 1200° F, enters the retort through a distributor similar to the one described in the direct heated operation. Another portion of the recycle gas, now heated passes through line 79 and enters the retort at a point substantially below the entry of hot gas through line 78 and substantially above the exit of sulfur free gas which leaves the retort at moderate pressure above atmospheric and a temperature of about 700° F and passes through dust collector 81, consisting of cyclones or other devices for removal of dust. A portion of this gas passes through line 82 for combustion in the heater and the remaining portion of the gas passes through control valve 83 which is actuated by a controller to maintain the retort top pressure at a preset pressure slightly above atmospheric pressure in the top of the retort. The excess sulfur free product gas, beyond the requirements for the heater, could be conducted to a gas reformer, not shown. In the reformer, well known in the art, a mixture of steam and the gas is passed over a hot catalyst for conversion to a synthesis gas consisting principally of hydrogen and carbon monoxide. The further reaction of steam with carbon monoxide produces a mixture of hydrogen and carbon dioxide. Further treatment of the gas results in the production of high purity hydrogen suitable for hydro-treating the crude shale oil for removal of sulfur and nitrogen.

Figure 4:
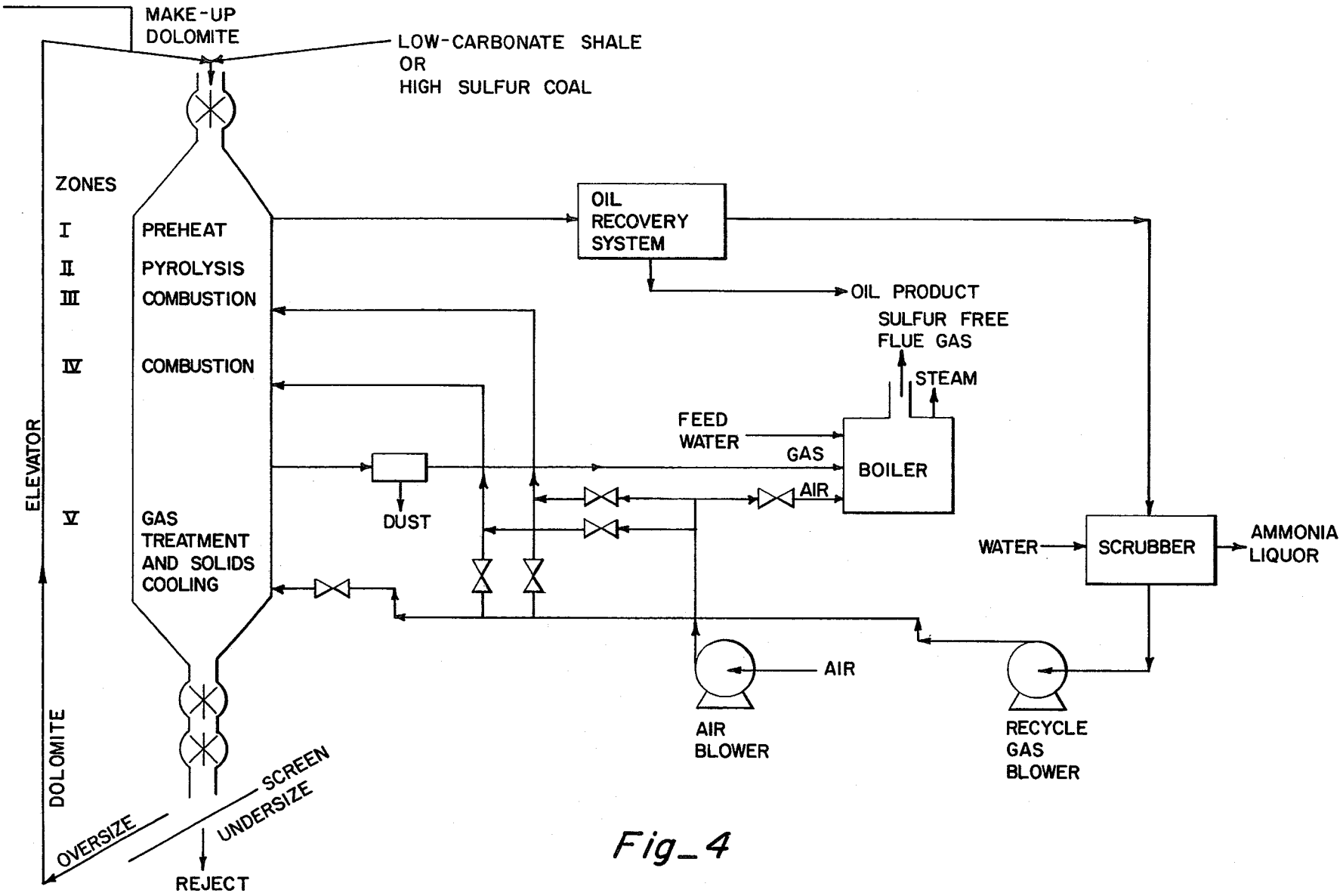
FIG. 4 is a flow diagram showing the utilization of a vertical kiln to process non-carbonate oil shale or high sulfur, high ash coal to produce an essentially sulfur free product gas.

The schematic flow sheet in FIG. 4 shows the utilization of a vertical kiln to produce oil from a low carbonate oil shale, such as the Devonian shales of the eastern United States, by an internal combustion method. Since those shales do not contain adequate magnesium and/or calcium carbonates to remove the sulfur from the gas produced from pyrolysis, the present invention provides for a mixture of the low carbonate shale and a carbonate rock, such as dolomite, passing this mixture through an internal combustion retorting operation, such as shown in FIG. 1. The mixed solids descend in sequence through five zones in the vertical kiln. In zone I, the solids are preheated, in zone II the shale undergoes pyrolysis to form oil vapor and gas and a carbonaceous residue on the shale, in zone III combustion is maintained in the vertical kiln by the addition of air and recycle gas, and in zone IV (at a level below zone III) an additional combustion zone is maintained by the further addition of air and gas mixture. The solids now having been heated to approximately 1200° F descend into zone V for gas treatment and the cooling of the solids before being removed from the kiln at the bottom through two rotary seals. In zones III and IV, a temperature level is such that the outside layer of the dolomite lumps becomes calcined to form magnesium oxide which is the reactant for removing the hydrogen sulfide produced by pyrolysis in the descent of the shale through zone 2. The mixed solids leaving the bottom of the kiln pass over a screen for preparation of over-size material for lifting, with an elevator, to be recharged to the top of the kiln and an under-size material which passes through the screen for rejection to a waste pile. The makeup dolomite has a size consist between 1½ inches and 3 inches, and the low carbonate shale, which is being processed, is sized to pass through an inch and a half screen. The bottom size range of the shale would be approximately three-eighths of an inch to assure porosity of the solid bed in the kiln. As the mixed solids pass over the screen, the shale falls through as undersize material and the dolomite is recycled through an elevator to the top of the kiln, since the majority of that material will still be above 1½ inches in size. As the recycled dolomite becomes subjected to cycles of partial calcination and reaction with sulfur compounds in the gas, the particles become softer on the surface and, as these particles are subjected to cycles of screening, the skin of the particle becomes abraded and, eventually, the dolomite particles become smaller than 1½ inches and pass through to the reject stream. Thus the shale is subjected to a single passage treatment through the kiln while the dolomite is recycled until it has reacted away and becomes discarded with the reject material. The makeup dolomite is added to maintain the inventory of dolomite in the system. The operation of the internal combustion kiln for the restoring of shale is conventional and has been described under FIG. 1. A portion of the gas recycled to the bottom of the kiln is disengaged at a level between the entering recycle gas at the bottom of the kiln and below the combustion zone No. IV. The hydrogen sulfide from pyrolysis and the sulfur dioxide which may be produced in the combustion zones III and IV react with the magnesium oxide and calcium oxide, and the treated gas is disengaged in an essentially sulfur free condition. The gas passes through a dust collecting system, such as cyclones, at a temperature of about 700° F and under a slight pressure from the retort. This gas is conducted to a boiler or furnace where the gas burns with air to release heat and generate steam from a feed water supplied to the boiler in a conventional manner. The sulfur free flue gas passes to the atmosphere without any further requirement for cleanup. The internal combustion system produces a relatively low heating value gas in the range of 100 – 200 BTU/CF. By virtue of this low heating value, combustion temperatures in the boiler are relatively low, thereby producing less nitrogen oxides than would normally be produced in the combustion in a boiler.

Figure 5:
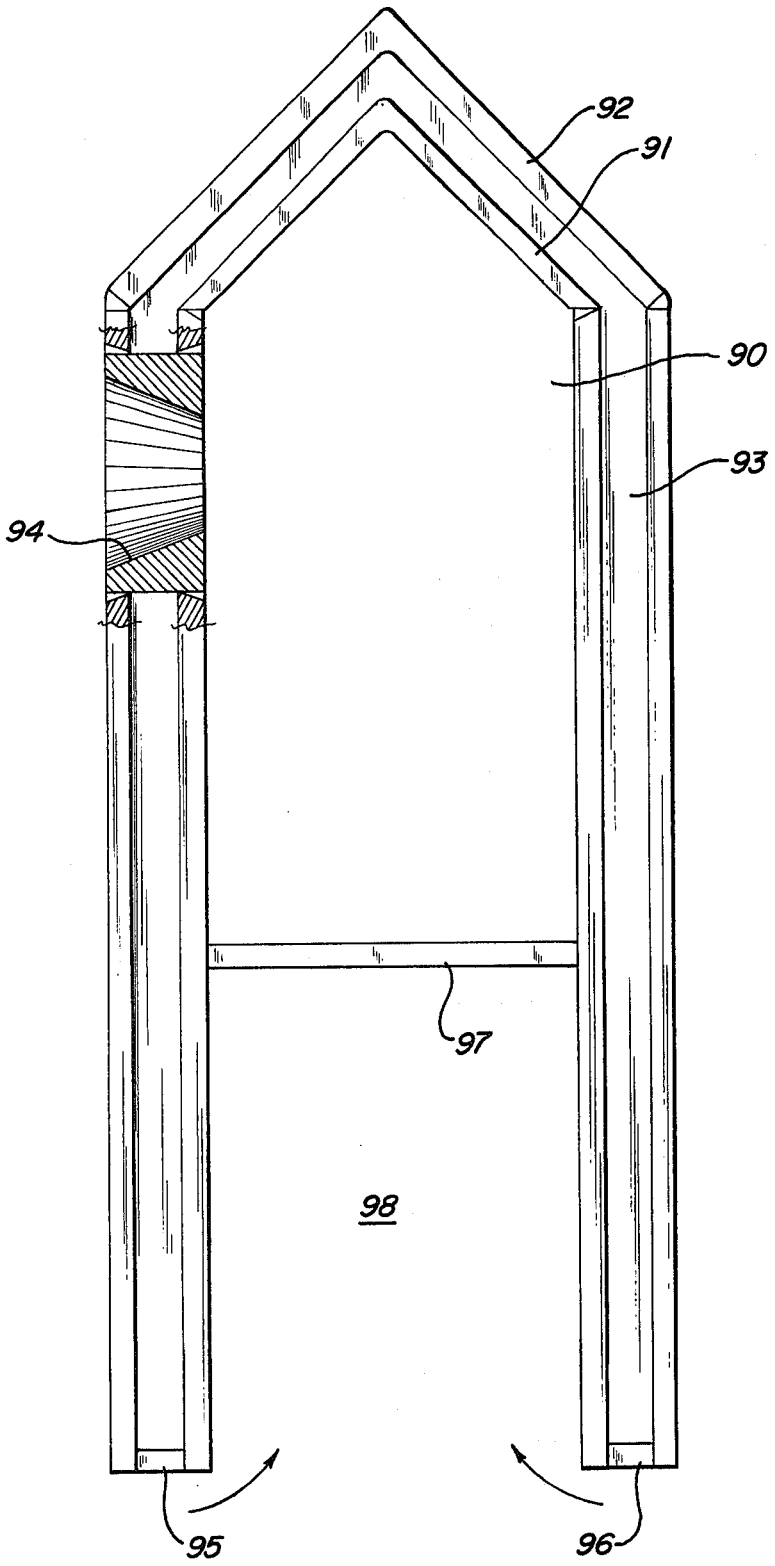
FIG. 5 shows a particular method of disengaging the hot desulfurized gas from the inside of the retort.

FIG. 5 shows a cross section through an air/gas distributor which is combined with an off-gas collector for removal of the hot sulfur-free gas produced in the lower part of the kiln. The unit includes a tubular gas distributor 90 enclosed by a water jacket 93 composed of inside wall 91 and outside wall 92. The water jacket is provided with vertical side walls and a peaked top, sloped at more than the repose angle of the particulate material of the kiln. The gas distributor is tubular, closed at the bottom by wall 97 and is fed gas from both ends. The gas is distributed into the shale bed by orifices 94, which are spaced along both sides of the distributor. Product gas is withdrawn from the kiln by off-gas collector 98, below plate 97. The gas is withdrawn from both ends of the chamber 98. The water jacket extends down the wall of the collector, and the jacket is closed by bars 96 and 95 which may be welded in place. The product gas disengages from the shale and is transferred from the kiln to points of use as explained above. The cooling jacket normally cooled with water allows the disengagement of the hot product gas at temperatures in excess of 900° F without requiring the use of high temperature alloy steels such as stainless steel.

Table 1 is a summary of gas desulfurization tests conducted in an oil shale retort when operated in two different heating modes. The gas entered the kiln bottom at about 230° F and the retorted shale was being discharged at about 320° F. The gas sample probe was located 8½ feet above the point of gas injection and the temperature of the probe was about 1000° F. Sulfur dioxide is normally not present in the direct heating mode in significant amounts; however, the one test shows that sulfur dioxide was reduced from 18 ppm down to 1 ppm passage through desulfurizing zone. In the indirect mode the hydrogen sulfide content of the untreated gas was more than 10 times that in the direct heating mode; however, the tests show that the treated gas was nearly completely desulfurized as in the case of the direct heating mode.

TABLE I

| Operating Mode | Gas Desulfurization Tests: Gas to Kiln Bottom | Gas at Kiln Sample Probe |
|---|---|---|
| Direct Heating | .23% $H_2S$ | 28ppm $H_2S$ at 1000° F |
| | .27% $H_2S$ | 11ppm $H_2S$ at 980° F |
| | .22% $H_2S$ | 11ppm $H_2S$ at 980° F |
| | .56% $H_2S$ | 6ppm $H_2S$ at 1020° F |
| | .57% $H_2S$ | 2ppm $H_2S$ at 1080° F |
| | 18ppm $SO_2$ | 1ppm $SO_2$ at 1080° F |
| Indirect Heating | 3.4% $H_2S$ | 18ppm $H_2S$ at 980° F |
| | 3.7% $H_2S$ | 18ppm $H_2S$ at 980S° F |
| | 3.8% $H_2S$ | 11ppm $H_2S$ at 980° F |

The resulting product gas after being treated by the hot retorted shale is environmentally clean for subsequent use without other treatment. With western United States shales, sufficient calcium or magnesium oxides are present, when the retorting temperature is above about 1100° F, so that nothing need be added. With other shales additional dolomite is added to produce the treating substance.

We claim:

1. A process for eliminating sulfur contaminants from the combustible gas produced from a pyrolysis of an oil shale containing calcium or magnesium carbonate calcinable to a sufficient quantity of calcium or magnesium oxides to react with all sulfur compositions present in the gas, with the pyrolysis being conducted at least above about 900° F, which comprises passing a produced gas from an oil shale pyrolysis through a column of hot retorted oil shale which contains at least partially decomposed calcium or magnesium carbonate, said retorted shale being sufficiently hot so that the produced gas may be withdrawn at a temperature in excess of at least 700° F and be essentially free of sulfur contaminants.

2. A process according to claim 1 wherein
the column of retorted shale is at a temperature profile of from about 200° F at the bottom to about 700° F at the point of removal of said produced gas.

3. A process according to claim 1 wherein
the zone for pyrolysis and the column of retorted shale are contiguous.

4. A process according to claim 1 wherein the essentially sulfur free produced gas is withdrawn from the column at a temperature of at least about 900° F.

5. A process according to claim 1 wherein the pyrolysis is conducted in an elongated vertical column of oil shale, with pyrolysis occurring in an upper portion of the column, gas produced in the pyrolysis withdrawn from the column and is cooled to less than about 250° F. and then passed into the bottom of the column, and the gas heated by the retorted shale on passing upwardly through the column is withdrawn below the pyrolysis zone is positioned above the mid point of the column and produced gas is passed into the bottom of the column and essentially sulfur free gas is withdrawn immediately below the pyrolysis zone.

6. A process according to claim 1, wherein calcium or magnesium carbonate is added to the oil shale prior to pyrolysis.

7. A process according to claim 1, wherein a single chamber, vertical vessel houses a gravity flow bed of oil shale in a column therein, and the pyrolysis zone is positioned above the mid point of the column and produced gas is passed into the bottom of the column and clean gas is withdrawn immediately below the pyrolysis zone.

8. A process according to claim 7, wherein the pyrolysis is by the direct mode providing combustion in the column.

9. A process according to claim 7, wherein pyrolysis is by the indirect mode providing a non-combustion pyrolysis of the oil shale by means of hot gases.

10. A process according to claim 1, wherein: high sulfur coal is added to the oil shale prior to pyrolysis.

11. A process according to claim 1, wherein: coke is added to the oil shale prior to pyrolysis.

* * * * *